United States Patent [19]

Kageyama

[11] Patent Number: 4,676,684

[45] Date of Patent: Jun. 30, 1987

[54] LEAD DELIVERY MECHANISM FOR MECHANICAL PENCIL

[75] Inventor: Hidehei Kageyama, Kawagoe, Japan

[73] Assignee: Kotobuki & Co., Ltd., Kyoto, Japan

[21] Appl. No.: 703,923

[22] Filed: Feb. 21, 1985

[30] Foreign Application Priority Data

Nov. 2, 1984 [JP] Japan ..... 59-165747[U]

[51] Int. Cl.[4] ..... B43K 21/00; B43K 21/22

[52] U.S. Cl. ..... 401/65; 401/85; 401/86; 401/94

[58] Field of Search ..... 401/53, 94, 65, 67, 401/85, 89, 86

[56] References Cited

U.S. PATENT DOCUMENTS

| | | | |
|---|---|---|---|
| 3,836,264 | 9/1974 | Saito et al. | 401/65 |
| 3,998,558 | 12/1976 | Katz | 401/94 |
| 4,171,170 | 10/1979 | Kageyama et al. | 401/65 |
| 4,343,558 | 8/1982 | Fujiwara | 401/67 |
| 4,371,277 | 2/1983 | Kageyama et al. | 401/65 |
| 4,386,865 | 6/1983 | Kageyama et al. | 401/67 |

FOREIGN PATENT DOCUMENTS

| | | | |
|---|---|---|---|
| 875930 | 5/1953 | Fed. Rep. of Germany | 401/94 |
| 278014 | 9/1951 | Switzerland | 401/67 |
| 479937 | 2/1938 | United Kingdom | 401/65 |

*Primary Examiner*—Steven A. Bratlie

*Attorney, Agent, or Firm*—Sherman and Shalloway

[57] ABSTRACT

A lead delivery mechanism is integrally composed of a lead chuck for biting lead fitted to the extreme end of a lead pipe, sleeves abutting upon a chuck clamping ring loosely fitted to the head portion of the lead chuck, a spring member for clamping the chuck disposed resiliently between the sleeves and the lead pipe, and a locking ring locked loosely with the lead chuck to lock the rear end of the spring member, whereby such lead delivery mechanism may be handled as a block in assembly operations for mechanical pencils.

7 Claims, 10 Drawing Figures

LEAD DELIVERY MECHANISM FOR MECHANICAL PENCIL

BACKGROUND OF THE INVENTION

1. Field of the Invention

This invention relates to a mechanical pencil in which a lead chuck is provided with a locking member for locking a knocking spring member, whereby the assembly operation thereof becomes easy.

2. Description of the Prior Art

As such type of mechanical pencils, there has been heretofore proposed, for example, one shown in FIG. 1 wherein the extreme end of a lead pipe 1 is provided with a lead delivery mechanism comprising a lead chuck 2, a chuck clamping ring 3, a sleeve 4, a spring for shock-absorbing excessive writing pressure 5, and a spring for clamping the chuck 6. In this case, the lead delivery mechanism 7 is attached to the lead pipe in such a manner that the chuck clamping ring 3, the sleeve 4, and the chuck clamping spring 6 are inserted into the rear end of the lead chuck 2, and then the lead chuck 2 is fitted into the extreme end of the lead pipe 1. As a result, the extreme end of the lead pipe 1 is pushed rearwards by means of urging force of the chuck clamping spring 6. Thus there have been such problems that the fitting operation is accompanied by difficulty, that it is necessary for arresting the spring 6 by means of fingers or jigs (not shown), and that efficiency in assembly operation decreases.

SUMMARY OF THE INVENTION

Accordingly it is an object of the present invention to eliminate the above described disadvantages and to provide a lead delivery mechanism for mechanical pencils by which efficiency in assembly operations such as attachment of the lead delivery mechanism to a lead pipe and the like operation can be significantly improved by such a manner that a locking ring for locking a chuck clamping spring member is engaged with a lead chuck, whereby the lead delivery mechanism is integrally united so that such lead delivery mechanism may be handled as a block.

The lead delivery mechanism for mechanical pencils according to the present invention comprises a lead chuck for biting lead fitted to the extreme end of a lead pipe, sleeves abutting upon a chuck clamping ring loosely fitted to the head portion of said lead chuck, a spring member for clamping said chuck disposed resiliently between said sleeves and said lead pipe, and a locking ring locked loosely with said lead chuck to lock the rear end of said spring member.

The above and other objects of the invention will become apparent from the following detailed description taken in conjunction with the accompanying drawings.

DESCRIPTION OF THE PREFERRED EMBODIMENTS

An embodiment of the present invention will be described hereinbelow by referring to the accompanying drawings.

Figure 1:
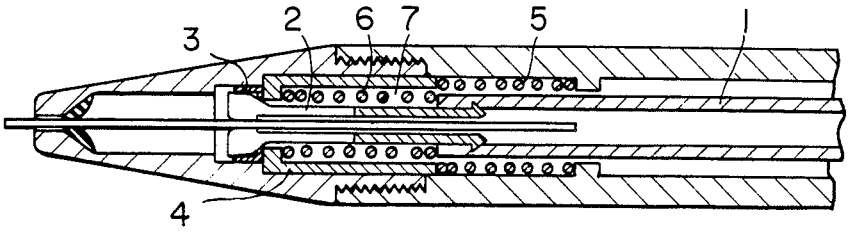
FIG.1 (PRIOR ART)
FIG. 1 is a longitudinal sectional view showing a part of a conventional mechanical pencil.
Figure 2:
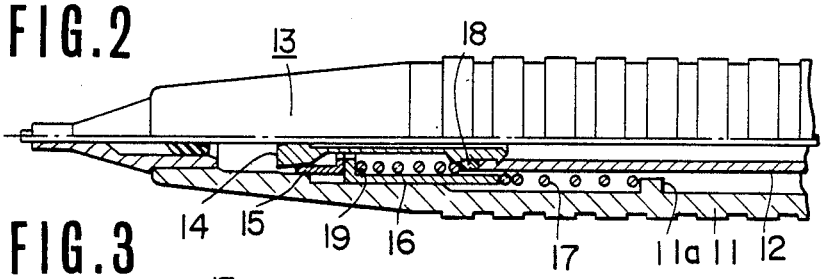
FIG. 2 is a longitudinal sectional view showing a part of the mechanical pencil of an embodiment according to the present invention.

As shown in FIG. 2, a lead pipe 12 being slidable along the axial direction is disposed inside an outer cylinder 11 of a mechanical pencil, a lead delivery mechanism 13 is mounted to the extreme end of the lead pipe 12.

The aforesaid lead delivery mechanism 13 comprises a lead chuck 14 for biting lead fitted to the extreme end of said lead pipe 12, a chuck clamping ring 15 fitted externally to the head portion of the lead chuck 14 in a manner slidable along the axial direction, a sleeve 16 for restricting movement of the chuck clamping ring 15 in the axial direction, a first spring member 17 for cushion disposed resiliently between the rear end of the sleeve 16 and an inner projection **11*a* of the outer cylinder 11, and a second spring member 19 for clamping the chuck disposed resiliently between the sleeve 16 and the lead pipe 12 through a locking ring 18** which will be described hereinbelow.

Figure 3:
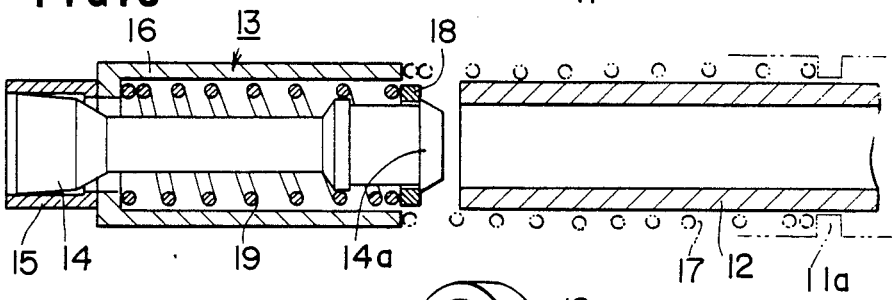
FIG. 3 is a longitudinal sectional view showing an essential part of the lead delivery mechanism of the embodiment of FIG. 2.
Figure 4:
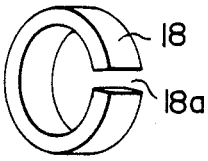
FIG. 4 is a perspective view showing a locking ring utilized in the present invention.

In accordance with the present invention, particularly as shown in FIGS. 2 and 3, the rear end of the second spring member 19 is locked by a lead pipe biting stepped portion (hereinafter referred to simply as "stepped portion") **14*a* of the lead chuck 14 and the locking ring 18 fitted loosely. The locking ring 18 inserted from the rear end of the lead chuck 14 over the stepped portion 14*a*. The locking ring 18 is so formed that when it is engaged with the stepped portion 14*a*, the locking ring 18 does not easily drop away. For instance, the locking ring 18 is formed in a manner being capable of expansion and contraction in the diametrical direction by forming such member with a material which may be deformed elastically along the diametrical direction or by defining a split 18*a* in the member as shown in FIG. 4**.

Next, operation of the present invention will be described hereunder.

The lead delivery mechanism 13 is assembled by arranging successively the chuck clamping ring 15, sleeve 16, and the second spring member 19 therewith through the rear end of the lead chuck 14, and then the locking ring 18 is similarly mounted to them to lock the stepped portion **14*a* of the lead chuck 14 as shown in FIG. 3. In this situation, the locking ring 18 locks the rear end of the second spring member 19, whilst the locking ring is pushed against the stepped portion 14***a* by means of urging force of the second spring member 19 thereby uniting the lead delivery mechanism 13 except for the first spring member 17, so that such lead delivery mechanism may be handled as a block. In this construction, when the lead delivery mechanism 13 is mounted to the lead pipe 12, there is no need for arresting the second spring member 19 by means of fingers or jigs unlike assembly in conventional mechanical pencils, but the assembly can easily be carried out so that efficiency in the assembly is remarkably elevated. In this case, since the locking ring 18 shifts forwardly against urging force of the second spring member 19 in the course where the lead chuck 14 is fitted to the extreme end of the lead pipe 12, the lead chuck 14 is inserted into the extreme end of the lead pipe 12 with a sufficient length so that the lead chuck is firmly fitted thereto. Furthermore since the rear end of the second spring member 19 for clamping the chuck is locked by the locking ring 18 having an abutting surface of high precision, stable resilient fitting is effected so that extremely positive and stable chuck clamping action can be realized.

Figure 5:
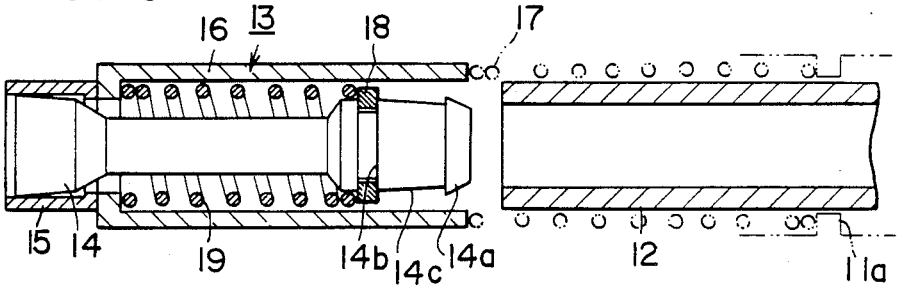
FIG. 5 is a longitudinal sectional view showing an essential part of the lead delivery mechanism of another embodiment according to the present invention.

FIG. 5 illustrates the lead delivery mechanism of another embodiment according to the present invention wherein a stepped portion 14*b* for locking the locking ring 18 is formed at a position apart from the rear end of the lead chuck 14 with a prescribed distance. Based on the formation of the stepped portion 14*b* at the position as described above, an inserting portion 14*c* which is not affected by urging force of the second spring member 19 can be ensured in the case when the rear end of the lead chuck 14 is inserted into the lead pipe 12, and as a result both the members can more simply and stably be fitted to each other.

Figure 6:
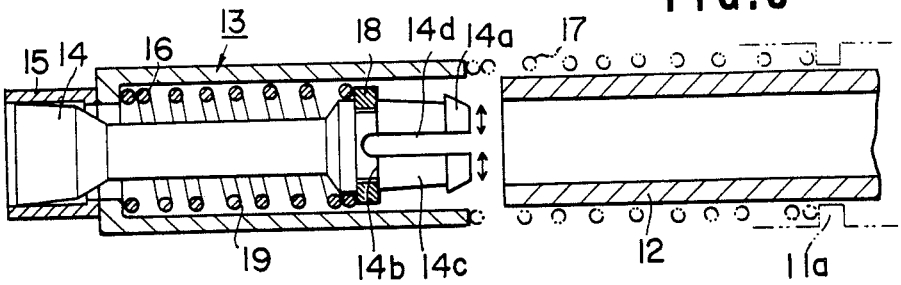
FIG. 6 is a longitudinal sectional view showing an essential part of the lead delivery mechanism of still another embodiment according to the present invention.

FIG. 6 illustrates the lead delivery mechanism of another embodiment according to the present invention wherein a slot 14*d* extending axially is defined at the rear end of the lead chuck 14. In the present embodiment, since the rear end of the lead chuck 14 may be expanded and contracted diametrically as indicated by the arrows, there is no need for deforming the locking ring 18 or defining the slit 18*a* therein as mentioned above.

Figure 7:
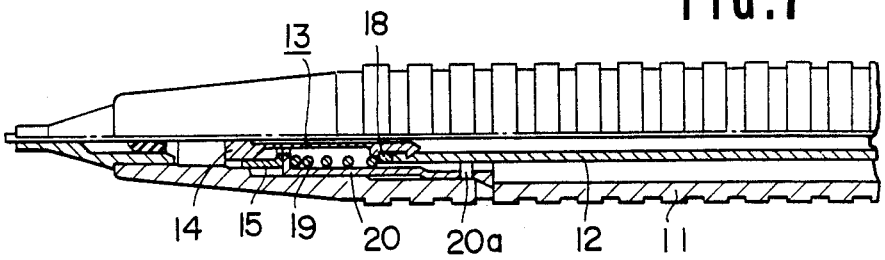
FIG. 7 is a longitudinal sectional view showing a part of the mechanical pencil of a further embodiment according to the present invention.
Figure 8:
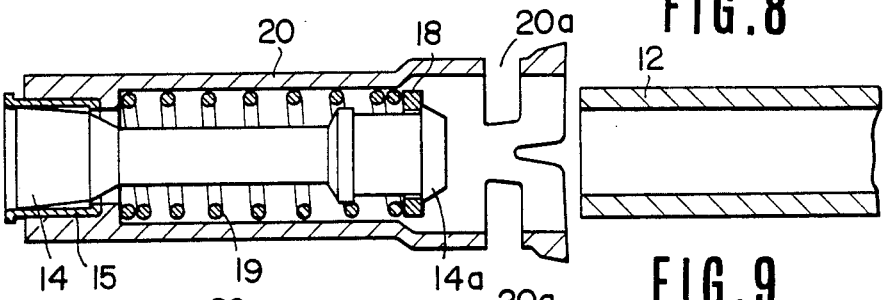
FIG. 8 is a longitudinal sectional view showing an essential part of the lead delivery mechanism of the embodiment of FIG. 7.

FIG. 7 and FIG. 8 being an enlarged view showing the essential part of the lead delivery mechanism of FIG. 7 illustrate another embodiment wherein a cushion sleeve 20 having a cushion portion 20*a* is applied to the lead delivery mechanism as a sleeve. In the present embodiment, the same effects with those of the above-mentioned first embodiment can be obtained by means of the locking ring 18 besides, the second spring member 19 for shock-absorbing excessive writing pressure becomes unnecessary, because of provision of the cushion sleeve 20, so that the assembly operation can be efficiently effected.

Figure 9:
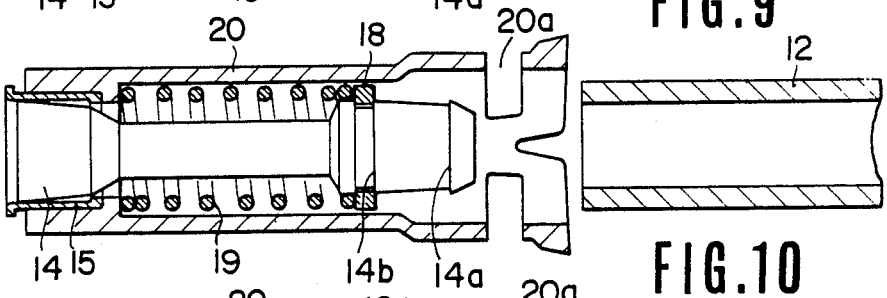
FIGS. 9 and 10 are longitudinal sectional views each showing an essential part of the lead delivery mechanism of a still further embodiment according to the present invention.

FIG. 9 illustrates the lead delivery mechanism of another embodiment according to the present invention wherein the locking ring 18 and the locking stepped portion 14*b* are formed at the position apart from the rear end of the lead chuck 14 with a prescribed distance as in the embodiment of FIG. 5. In this embodiment, both the members can be easily and stably assembled without being affected by urging force of the second spring member 19 as in the embodiment of FIG. 5.

Figure 10:
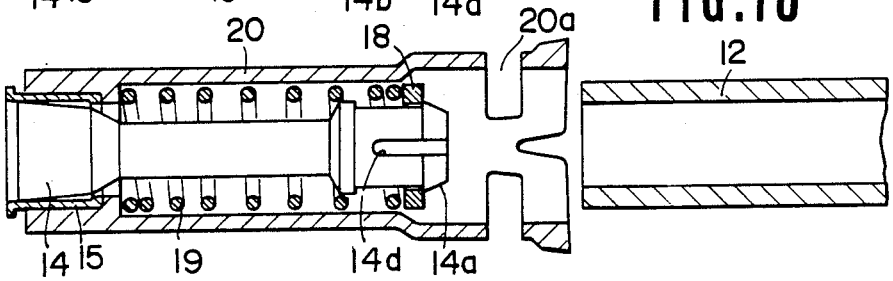

FIG. 10 illustrates the lead delivery mechanism of another embodiment according to the present invention wherein a slot 14*d* is defined at the rear end of the lead chuck 14 also as in the embodiment of FIG. 6, so that the same effects as those of FIG. 6 can be obtained.

While the present invention has been applied to such a mechanical pencil comprising a spring member for shock-absorbing excessive writing pressure in the above described embodiments, respectively, the invention is not limited thereto, but it may, of course, be applied also to a mechanical pencil comprising a spring member for clamping a chuck, but no spring member for shock-absorbing excessive writing pressure.

As described above, since the locking ring locking the rear end of the spring member for clamping chuck is engaged with the lead chuck in the present invention, it exhibits very excellent advantages such that the lead delivery mechanism can be integrally united, in other words, the mechanism may be handled as a block, so that assembly operations, for example, attachment of the lead delivery mechanism to the lead pipe can be efficiently carried out.

Although the present invention has been described with reference to preferred embodiments thereof, many modifications and alterations may be made within the spirit and scope of the invention.

What is claimed is:

1. A lead delivery mechanism for mechanical pencils comprising a lead chuck for biting lead fitted to the extreme end of a lead pipe, a sleeve abutting upon a chuck clamping ring loosely fitted to the head portion of said lead chuck, a spring member for clamping said chuck disposed resiliently between said sleeve and said lead pipe, and a split resilient locking ring resiliently forced over a stepped portion formed at a rear end of said lead chuck, said locking ring seating in a groove in said lead chuck forward of said stepped portion to lock the rear end of said spring member, said locking ring retainine said spring member mounted in said mechanism even with said lead pipe disassembled therefrom.

2. A lead delivery mechanism for mechanical pencils as claimed in claim 1 further comprising a spring member for shock-absorbing excessive writing pressure.

3. A lead delivery mechanism for mechanical pencils as claimed in claim 1 wherein said locking ring is formed by a material which may be deformed elastically along the diametrical direction.

4. A lead delivery mechanism for mechanical pencils as claimed in claim 1 wherein said groove for locking said locking ring is formed at a position spaced apart from the rear end of said lead chuck by a predetermined distance.

5. A lead delivery mechanism for mechanical pencils as claimed in claim 1 wherein a slot extending axially is defined at the rear end of said lead chuck.

6. A lead delivery mechanism for mechanical pencils as claimed in claim 1 wherein a cushion sleeve having a cushion portion is used as said sleeve.

7. A lead delivery mechanism for mechanical pencils comprising a lead chuck for biting a lead, a sleeve abutting upon a chuck clamping ring loosely fitted to a head portion of said lead chuck, a split resilient locking ring resiliently forced over a stepped portion formed at a rear end of said lead chuck, said locking ring seating in a groove in said lead chuck forward of said stepped portion, and a resilient member for clamping said lead chuck disposed resiliently between said locking ring and said sleeve, said locking ring being the sole means for retaining said resilient member in resilient engagement with said sleeve.

* * * * *